United States Patent [19]

Kuo et al.

[11] 4,047,180

[45] Sept. 6, 1977

[54] BROADBAND CORRUGATED HORN ANTENNA WITH RADOME

[75] Inventors: Samuel Chung-Shu Kuo, Saratoga; William D. Rosser, Los Altos, both of Calif.

[73] Assignee: GTE Sylvania Incorporated, Mountain View, Calif.

[21] Appl. No.: 691,321

[22] Filed: June 1, 1976

[51] Int. Cl.[2] ..... H01Q 13/06

[52] U.S. Cl. ..... 343/784; 343/786; 333/83 A

[58] Field of Search ..... 343/784, 786, 872; 333/83 A

[56] References Cited

U.S. PATENT DOCUMENTS

| | | | |
|---|---|---|---|
| 2,548,821 | 4/1951 | Riblet et al. | 343/784 |
| 2,767,396 | 10/1956 | Cutler | 343/786 |
| 3,530,480 | 9/1970 | Roagved et al. | 343/784 |
| 3,611,396 | 10/1971 | Jones | 343/786 |

*Primary Examiner*—Eli Lieberman
*Attorney, Agent, or Firm*—John F. Lawler

[57] ABSTRACT

A broadband (8–18 GHz) radomed horn antenna system comprises a conical horn having broadband slots on the inner surface and a radome having a frusto-conical side wall and a spherically shaped transverse wall inserted into the horn. The radome wall is thin relative to operating wavelength. The radome side wall fits snugly against the inner surface of the horn wall so that transverse wall is proximate to the horn feed port with its convex side facing toward the horn aperture. The cylindrical feed guide contains a higher order hybrid mode suppressor which maintains a substantially uniform radiation pattern over the operating band with an acceptable insertion loss.

4 Claims, 4 Drawing Figures

BROADBAND CORRUGATED HORN ANTENNA WITH RADOME

BACKGROUND OF THE INVENTION

This invention relates to antennas and more particularly to broadband horn antennas.

The conical corrugated horn antenna, known also as the scalar horn antenna, has an inner surface formed with coaxial axially spaced corrugations or slots which produce a far field circularly symmetrical constant beamwidth. The useful bandwidth of such a horn, however, is approximately 1.7:1 which limits its application. For example, there are microwave receivers currently available which may be tuned over frequency ranges of 8–12 GHz and 12–18 GHz, respectively, so that two such receivers may be employed in tandem to cover the 8 to 18 GHz band. It is advantageous for many reasons to have two such receivers share a single antenna but to accomplish this the antenna must have an operating bandwidth of at least 2.25:1, i.e., it must have acceptable performance characteristics over this band.

Efforts to extend the bandwidth of the corrugated horn antenna have included forming the horn with broadband slots such as partial dielectrically loaded slots, tapered slots, or ridge loaded slots, the latter being described in a paper entitled "The Ring Loaded Corrugated Waveguide" by Y. Takeichi et al published in IEEE Transactions on Microwave Theory and Techniques, December 1971, pages 947–950. While such horn constructions have resulted in some bandwidth improvement, the radiation pattern nevertheless still deteriorates at the upper end of 8 to 18 GHz band so that the antenna is unacceptable for use in high performance receiving systems operating over this band.

A technique for increasing the bandwidth of the corrugated horn antenna to cover the 8–18 GHz range is described in the copending application of Craig Roberts and Samuel Kuo, Serial No. 691322, assigned to the assignee of this application, and consists generally of suppressing higher order conventional modes produced in the feed waveguides which ultimately cause pattern deterioration. This technique includes the use of mode suppressors in the input feed waveguide for horns having broadband corrugations and which propagate into open space. There are applications, however, which because of the environment in which the horn must operate require the use of a radome on the horn in order to mechanically seal the antenna system. The difficulty with use of a conventional radome over the aperture of the horn is that it distorts waves propagating through the radome wall at some frequencies in the 8–18 GHz operating band producing side lobes and narrowing of the radiation pattern, especially in the E-plane. Such adverse effects on antenna performance have precluded use of radomed horns over this frequency range.

OBJECTS AND SUMMARY OF THE INVENTION

A general object of this invention is the provision of a broadband corrugated horn antenna having a radome which has negligible adverse effects on antenna performance.

A further object is the provision of a radomed horn antenna system capable of operating satisfactorily over a band of 8 GHz to 18 GHz.

These and other objects of the invention are achieved with a radome having a dielectric wall sufficiently thin relative to operating wavelength to permit distortionless propagation of waves therethrough while being shaped to provide sufficient mechanical strength to endure severe environmental demands. Such a radome has a frusto-conical wall which fits snugly against the conical interior surface of the horn and also has an integral spherically shaped transverse wall of small diameter proximate to the feed end of the horn.

DESCRIPTION OF PREFERRED EMBODIMENT

Figure 1:
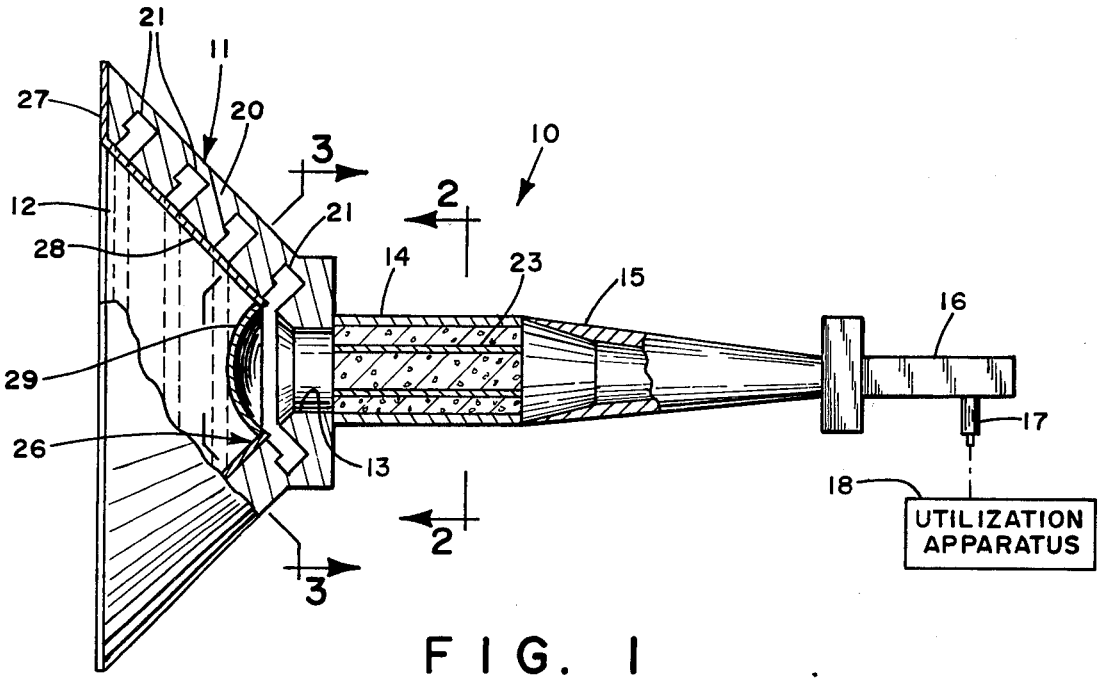
FIG. 1 is an elevation partly in section of a conical horn antenna system embodying the invention.

Referring now to the drawings, an antenna system 10 embodying the invention is shown in FIG. 1 and comprises a conical horn 11 with a circular aperture 12 and a circular feed port 13, a cylindrical waveguide 14 connected to port 13, a broadband tapered ridged circular-to-rectangular transition waveguide 15, a ridged rectangular waveguide 16 connected to transition waveguide 15 and a coaxial cable 17 connecting waveguide 16 to utilization apparatus 18. By way of example, apparatus 18 may comprise two receivers tunable over frequency ranges of 8–12 GHz and 12–18 GHz, respectively.

Horn 11 has an outwardly flared wall 20 with a plurality of coaxial axially spaced annular slots or corrugations 21 on its inner surface, the cross-sectional profile of each slot resembling a ring loaded or ridged configuration. The effect of such ring loading or ridging is to extend the capacitive bandwidth of the corrugations so that the depth of each remains between one-quarter and one-half wavelength over the operating frequency range. Other techniques for similarly extending the bandwidth of the horn are the use of partial dielectrically loaded slots or tapered slots.

Figure 2:
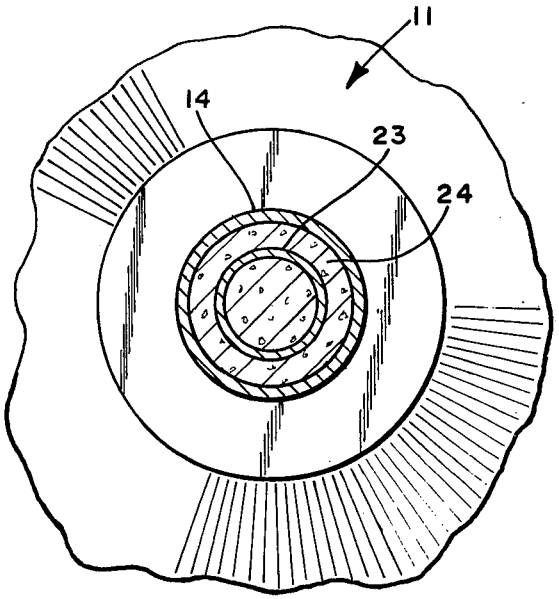
FIG. 2 is an enlarged transverse section taken on line 2—2 of FIG. 1.

Extension of the horn bandwidth by shaping the corrugations therein, however, is insufficient to permit operation of the system over the 8 to 18 GHz because coupling to higher order hybrid modes in the horn at the upper end of that band cause an unacceptable deterioration in the radiation pattern. In order to prevent such pattern deterioration, mode suppressor means comprising a cylindrically shaped resistance card 23, see FIGS. 1 and 2, is supported in a wave transparent dielectric substance 24 such as polystyrene foam in radially spaced relation to the waveguide wall. Resistance card 23 may be metallized polyester resin film approximately 0.005 cm thick and functions to suppress the $TM_{11}$ mode in waveguide 14 so as to prevent coupling to the horn of modes higher than the fundamental hybrid mode that cause pattern deterioration. While card 23 does introduce a maximum insertion loss of approximately 1.5 db at some frequencies so that the gain of the system is reduced slightly, the performance of the antenna over the frequency range is otherwise substantially unaffected.

Figure 3:
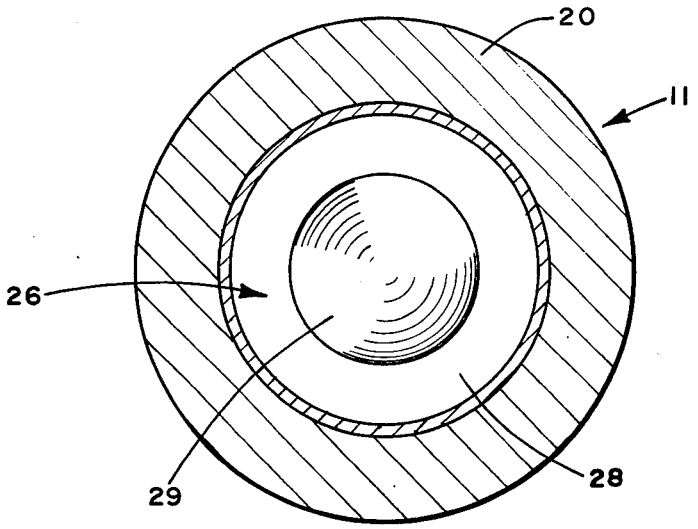
FIG. 3 is an enlarged transverse section taken on line 3—3 of FIG. 1.

In order to mechanically seal the interior of the antenna system from the environment, a radome 26 is secured to horn 11, see FIGS. 1 and 3. Radome 26 comprises a one-piece dielectric structure having a flange 27 which abuts the front face of the horn, a frusto-conical portion 28 and a transverse spherically shaped wall 29 with its convex surface facing the horn aperture. Radome portion 28 has substantially the same cone angle and diameter as the inside surface of horn 11 so that the radome fits snugly within the horn and against its inner surface. The axial length of the radome is slightly less than that of the horn interior so that transverse wall 29 is proximate to but spaced forwardly from port 13. The thickness of the radome wall is relatively thin with respect to the operating wavelength so as to prevent distortion of radiation patterns. Nevertheless the support derived by the radome from abutment against the horn surface together with the spherical shape of the transverse unsupported wall 29 insure sufficient mechanical strength to withstand severe environmental conditions including high winds and pressures.

An antenna embodying this invention and having the following characteristics was built and successfully operated:

| | |
|---|---|
| Conical horn | |
| Flare angle | 100° |
| Corrugations | ring loaded |
| Length | 2.54 cm. |
| Radome | |
| Material | Epoxy/Quartz fiber |
| Thickness | 0.05 cm. |
| Radius of transverse wall | 17.8 cm. (spherical) |
| Cylindrical waveguide | |
| Diameter | 2.45 cm. |
| Length | 2.54 cm. |
| Resistance card | |
| Material | Metallized polyester resin film |
| Diameter | 1.5 cm. |
| Thickness | 0.005 cm. |
| Dielectric | polystyrene foam |
| Operating frequency | 8–18 GHz |
| Insertion Loss (mode suppressor & radome) | 1.5 db max. |
| VSWR | <1.6 |

Figure 4:
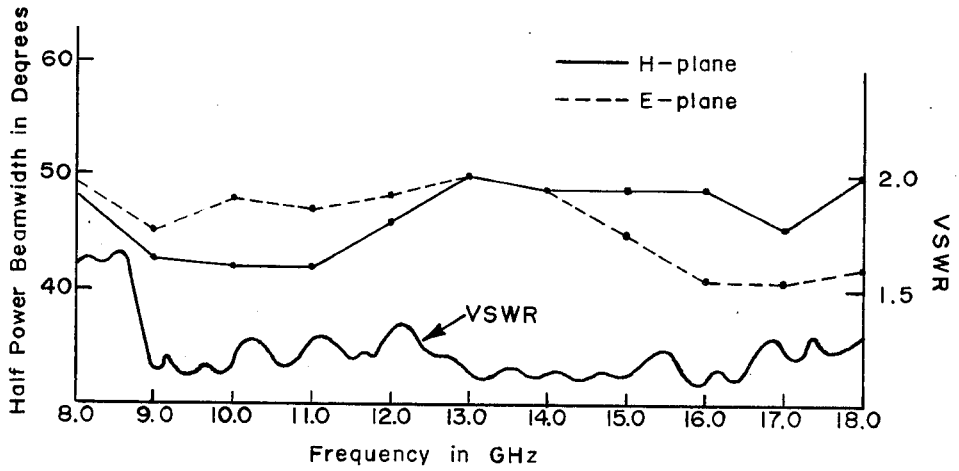
FIG. 4 is a plot of actual performance characteristics of a radomed horn embodying this invention.

FIG. 4 illustrates plots of the beamwidth and VSWR characteristics of the foregoing antenna over the 8–18 GHz frequency band. It will be noted that the E and H-plane half power beamwidths vary less than 10° from each other over the full operating band with a maximum deviation in either plane from a constant beamwidth of less than 5°. Also, the voltage standing wave ratio is less than 1.4 for over 90% of the operating band.

What is claimed is:

1. An antenna system operable over a wide frequency range comprising a conical corrugated horn antenna having an inner surface formed broadband slots and having an aperture and a feed port, a radome on said antenna, said radome having a frustoconical portion adjacent to the inner surface of said horn with an outer end coincident with said aperture and an inner end proximate to said feed port, said radome also having a spherically-shaped transverse wall across said inner end, the convex side of said wall facing the outer end of said radome, waveguide means connected to said port, said waveguide means comprising a ridged rectangular waveguide, a tapered transition waveguide connected to said ridged waveguide, and a cylindrical waveguide connected between said transition waveguide and said feed port of the horn, and hybrid mode suppressor means disposed within said cylindrical waveguide whereby to suppress higher order hybrid wave modes in said horn and correspondingly increase its operating bandwidth.

2. The antenna system according to claim 1 in which said mode suppressor means comprises a resistance card.

3. The antenna system according to claim 2 in which said resistance card is cylindrically shaped.

4. The antenna system according to claim 2 in which said transverse wall is spaced from said port toward said outer end of the radome.

* * * * *